4,357,777

United States Patent [19]

Kulik

[11] 4,357,777

[45] Nov. 9, 1982

[54] DIHEDRAL AERODYNAMIC STRUCTURE

[76] Inventor: Donald A. Kulik, 133 Richmond St. West, Toronto, Ontario, Canada, M5H 2L7

[21] Appl. No.: 866,480

[22] Filed: Jan. 3, 1978

[51] Int. Cl.[3] ..... A63H 27/00

[52] U.S. Cl. ..... 46/80; 244/38; 244/47; 244/49

[58] Field of Search ..... 244/46, 47, 49, 38; 46/79–81

[56] References Cited

U.S. PATENT DOCUMENTS

| | | | |
|---|---|---|---|
| 1,024,929 | 4/1912 | Pelterie | 244/47 |
| 1,599,280 | 9/1926 | Lewis | 46/80 |
| 1,974,656 | 9/1934 | Nelson | 46/80 |
| 2,154,487 | 4/1939 | Bonnell | 46/79 |
| 2,603,435 | 7/1952 | Metzler | 244/38 |
| 3,885,343 | 5/1975 | Fields | 46/81 |

FOREIGN PATENT DOCUMENTS

| | | | |
|---|---|---|---|
| 854384 | 4/1940 | France | 46/81 |
| 37 | of 1910 | United Kingdom | 46/79 |

*Primary Examiner*—Galen L. Barefoot

[57] ABSTRACT

The specification describes an aerodynamic structure having lift for use on an aerodyne. The structure comprises first and second essentially identical planar sections hingedly connected at their roots to one another at dihedral angles. The sections are moveable in unison to vary the angle between each section and its transverse axis.

4 Claims, 4 Drawing Figures

DIHEDRAL AERODYNAMIC STRUCTURE

FIELD OF THE INVENTION

This invention relates to an aerodynamic dihedral structure having lift and for use in an aerodyne.

BACKGROUND OF THE INVENTION

When an aerodyne is flying, it is important that it maintains a steady stable glide. Conventional aerodynes traditionally have the following prerequisites to assure longitudinal equilibrium and stability:

(1) equilibrium of aerodymanic and gravity forces and moments about the aircraft's mass centre; and (2) means for restoring the aircraft to equilibrium flight when disturbed from the glide path as a result of variations of these forces and moments. Conventionally, this is achieved for aircraft having wing-tail configurations by setting the rear stabilizer at a lower angle-of-attack than the wing, thereby providing a positive longitudinal reflex to the configuration.

Conventional aircraft are also generally fairly rigid in construction and the lift on the aircraft is primarily a function of the attack angle and the speed of the aircraft. With increasing speeds, lift increases pulling the airplane into a nose-up trajectory.

According to the present invention, an aerodynamic structure having longitudinal equilibrium and stability is provided without requiring essentially any longitudinal reflex because the centre of drag is above the structure's mass centre. The structure comprises first and second essentially identical planar sections hingedly connected at their roots to one another at dihedral angles. The sections are moveable in unison to vary the angle between each section and its transverse axis to alter the equilibrium flight angle and the degree of longitudinal stability.

According to one aspect of the invention and as opposed to conventional aircraft, the lift on the structure of the present invention decreases with increasing speed beyond a predetermined speed. Furthermore, when using a wing-tail configuration, no longitudinal reflex is required between the forward wing and the rear stabilizer to achieve longitudinal equilibrium and static longitudinal stability.

The above, as well as other features and advantages of the present invention will become apparent from the following detailed description of the preferred embodiments according to this invention, wherein.

DETAILED DESCRIPTION OF THE PREFERRED EMBODIMENT ACCORDING TO THIS INVENTION

Figure 2:
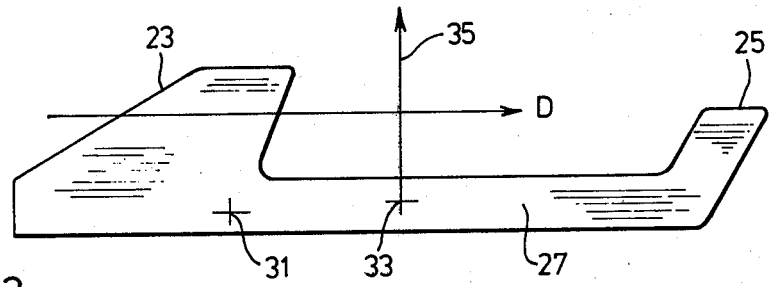
FIG. 2 is a side view of the aerodynamic structure according to this invention.
Figure 3:
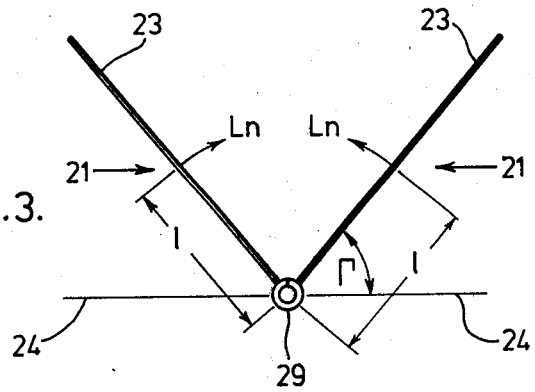
FIG. 3 is a front view of a slight modification of the structure shown in FIG. 2.

The structure of the present invention shown in FIGS. 2 and 3 comprises two planar sections generally indicated at 21, positioned at dihedral angles to their transverse axes 24. Each of the sections consists of a large forward wing 23 and elongated narrow body portion 27 and on empennage section 25. As best seen in FIG. 3, the forward wing, body portion and rear stabilizer all lie on the same plane. Furthermore, according to this embodiment they do not include any cambered surfaces.

The amount of lift achieved by the structure of the present invention is a function of its speed and its dihedral angle. This feature can be demonstrated by simply dropping it from an elevated location. Initially it is pulled downwardly by gravity and gains speed as it drops. However, an increase in speed results in a nose-up moment due to the dihedral shape, producing lift and causing it to perform either a partial or a complete loop, from which it eventually achieves an equilibrium glide, the speed of which is predetermined by the dihedral angle of the wings. The dihedral shape also benefits the lateral equilibrium and stability of the aircraft so that it flys in a steady upright position.

FIG. 2 shows an aerodynamic structure made from a single piece of resilient material centrally folded. FIG. 3 shows the same structure provided with an additional hinge spring 29. When the structure has the features shown in FIGS. 2 and 3 its lift automatically decreases as its speed increases beyond a certain value. This phenomenon occurs because the planar sections are hingedly connected to one another and moveable with respect to their transverse axes. Therefore, at maximum speeds the wings collapse inwardly and reduce the lift on the structure. Each wing's dihedral angle is a function of the spanwise-aerodynamic load placed on it and the degree of springiness at the hinged root. At positive angles-of-attack, the dihedral angle increases with increasing dynamic pressure. This lowers the wing's net lift and reduces the looping tendency. Mathematically this is shown as follows:

$$\Gamma = \Gamma o + \Delta\Gamma = \Gamma o + \frac{L_n l}{K} = \Gamma o + \frac{l}{K}\left(\frac{\rho V^2}{2} S_n CL_n\right), \quad (1)$$

where,

K≡the stiffness of spring 29, $L_n$≡net lift on each wing normal to each wing at a semispan location l, V≡wind speed, Γo≡dihedral angle when windspeed is zero, ρ≡air density, $S_n$≡the area of the wing half, and $Cl_n$≡the normal lift coefficient of the wing half.

Further, $$CL_n = (CL\alpha)_n \alpha_n = (CL\alpha)_n \alpha \cos \Gamma, \quad (2)$$

where, $\alpha_n$≡the angle of attack normal to the wing half,

α≡the angle of attack, and $(CL\alpha)_n$≡the normal lift-coefficient slope of the wing half.

Equations 1 and 2 result in:

$$\Gamma = \Gamma o + \frac{l}{K}\left[\frac{\rho V^2}{2} S_n (CL\alpha)_n \alpha \cos\Gamma\right], \quad (3)$$

thereby identifying the nondimensional dynamic pressure parameter:

$$\Lambda \equiv \frac{l}{K} \frac{\rho V^2}{2} S_n, \quad (4)$$

Equation (3) becomes:

$$\Gamma = \Gamma o + \Lambda (CL\alpha)_n \alpha \cos \Gamma. \quad (5)$$

Equation (5) is a transcendental equation for Γ. The derivative of this equation is:

$$\frac{d\Gamma}{d\Lambda} = \frac{(CL\alpha)_n \alpha \cos\Gamma}{(1 + \Lambda (CL\alpha)_n \alpha \sin\Gamma)}, \quad (6)$$

Therefore, for positive $(CL\alpha)_n$, α, and Γ the dihedral angle increases with increasing Λ. Therefore, for a given geometry (l, $S_n$) and spring constant (K) increasing Λ results in increasing dynamic pressure, q. Therefore, the net total lift of the wing is:

$$L = 2L_n \cos^2\Gamma = \rho V^2 S_n (CL\alpha)_n \alpha \cos^3\Gamma = \frac{2K}{l} \Lambda (CL\alpha)_n \alpha \cos^3\Gamma, \quad (7)$$

and the variation with Λ is:

$$\frac{dL}{d\Lambda} = \frac{2K}{l} (CL\alpha)_n \alpha \cos^3\Gamma - \frac{6K}{l} \Lambda (CL\alpha)_n \alpha \cos^2\Gamma \sin\Gamma \frac{d\Gamma}{d\Lambda}. \quad (8)$$

Figure 4:
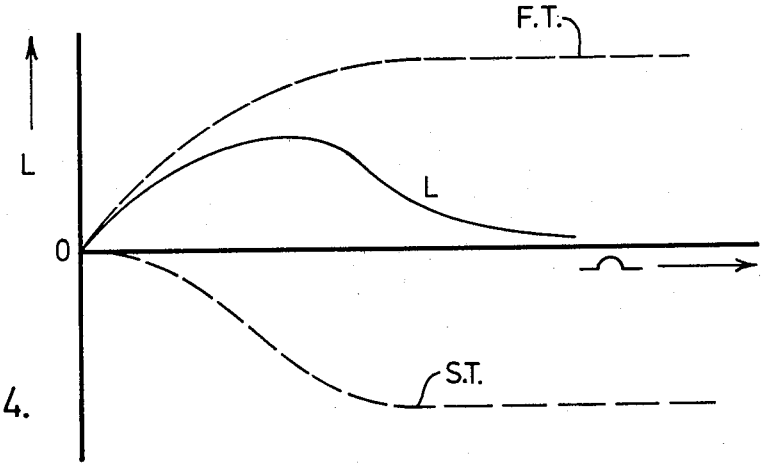
FIG. 4 is a graph demonstrating the lift characteristics of the structure shown in FIGS. 2 and 3 in response to dynamic pressures.

For given positive values of $(CL\alpha)_n$, α, Γ, and given $S_n$, l, and K, one sees that the first term of equation 8 gives an increase of lift with dynamic pressure, whereas the second term of equation 8 provides a decrease. At low dynamic pressures, the first term dominates, and at higher dynamic pressures, the second term becomes more important. A typical behavior of L is shown in FIG. 4, where FT is the first term and ST is the second term. Here it can be seen that lift initially increases with dynamic pressure to a maximum value and then decreases to an asymtotic value. Therefore, when the structure of the present invention experiences high q launch conditions in which the second term becomes dominant very quickly, there is a diminished looping tendency as compared with lower q launching conditions near the top of the launch trajectory.

When the aerodynamic structure of the present invention is used for a toy and launched from suitable means such as an elastic launcher, it achieves a high speed very quickly. At this high speed, the dynamic pressure on the wings is such that it may even fold them completely against one another and the structure flies essentially as a projectile. However, as the structure slows, due to air resistance and if it is launched upwardly, due to the pull of gravity, the resiliency or springiness of the hinge tends to separate the wings which results in increased lift. With this increased lift the structure begins to form loops or partial loops. Since the structure has a stable equilibrium position, it resumes an upright position by either completing the loop or by forming half a loop and then flipping upright. The structure attempts to sink under the pull of gravity. However, because stable equilibrium lift is produced as a result of its construction, the structure eventually assumes a constant glide speed through the combined effects of gravity and the lift produced. As will be appreciated at the constant glide speed the dynamic pressure on the wings is not adequate to fold them inwardly to any noticeable extent. After a prolonged glide period, the structure lands in a balanced position with its wings remaining upright.

As mentioned above, when the structure is launched at high q launch conditions, it acts essentially as a projectile. However, as it slows, the stabilizing forces of the dihedral come into play and the aerodynamic structure self corrects to an upright looping or gliding position because the two planar sections are essentially identical to one another and equally angled with respect to their transverse axes so that there is equal lift on either side of the structure. As can be appreciated from the above calculations, the lift on the structure can be changed by varying either the shape or the size of the wings so that the shape is not restricted to that shown in the drawings.

According to another embodiment of the invention, the structure can also be provided with control means for controlling the movement of the wings so that it is possible to open or fold the wings as desired rather than in response to dynamic pressures. This structure can also be propelled by some type of propulsion means and used for long distance flights. Again the lift is dependent upon the dihedral angle of the wings but the wings do not automatically fold as the speed increases. This would be controlled by the control means. Such an arrangement could be used in an aerodyne such as a drone provided with a remote control or a piloted aircraft. In order to maintain lift and lateral stability, the wings would be moved in unison and maintained at equal angles with respect to their transverse axes.

Figure 1:
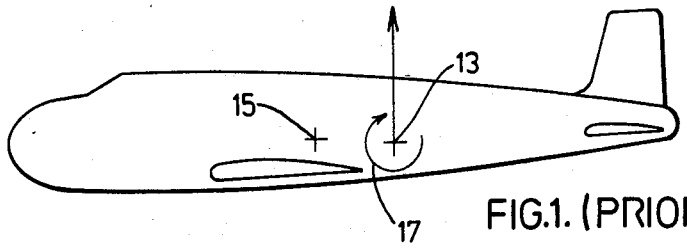
FIG.1. (PRIOR ART)
FIG. 1 is a side view of a conventional aircraft.

Returning to FIG. 1, a conventional aircraft generally has a longitudinal neutral point indicated at 13 about which the aerodynamic pitching moment, $M_{np}$, stays approximately constant for low to moderate angles-of-attack, α. If $M_{np}$ is positive such that the nose of the aircraft points up, then equilibrium can only be achieved by locating the centre of gravity indicated at 15 forward of the neutral point. However, since the aircraft's lift L in the direction of arrow 19 generally increases with increasing angle-of-attack (for low to moderate angles-of-attack), a restoring moment is generated about the centre of gravity opposite to the perturbation angle-of-attack direction. Mathematically, this is expressed as $(dMcg/d\alpha) < 0$. This is considered to be the criteria for aerodynamic static longitudinal stability. As mentioned above, positive $M_{np}$ is traditionally achieved in conventional wing-tail aerodyne configurations by setting the stabilizer at a lower angle-of-attack than the wing, thereby providing a positive longitudinal reflex to the configuration.

According to the present invention, an aerodynamic structure having a dihedral shape has no such geometrical longitudinal reflex because the forward wing and the rear stabilizer lie on the same plane. Downwash from the wing on the stabilizer is generally weak and is not the main longitudinal stabilizing factor.

The configuration of the dihedral structure places its centre of gravity 31 at a relatively low position, with the net-drag vector D well above that centre of gravity for low to moderate angles-of-attack. The lift on the structure is in the direction of arrow 35. Therefore, the large dihedral angle and the low centre of gravity produce a similar aerodynamic effect about the structure's neutral point 33 as that produced by positive longitudinal reflex without the requirement of geometrical positive longitudinal reflex.

The aerodynamic structure can obviously be built from many different types of materials. It may be constructed from a material such as lightweight plastic, thin wood, or according to a preferred embodiment from a pressed paper and for use as a child's play. The pressed paper should be folded precisely along its centre to provide a central longitudinal axis dividing the paper into two equally balanced planar sections. The paper should be flat with an interlocking grain to provide a central resilient hinge having a prolonged life expectancy. The longitudinal spine also adds substantially to the longitudinal strength of the structure. The resiliency of the hinge is an essential feature when the structure is used as a child's toy to provide automatic self correcting flight.

Where the structure is to be used in a powered aircraft, it is made from semi-rigid light weight materials such as wood, lightweight metal, or metal alloys. When the structure carries excess equipment, that equipment can be provided with cambered airfoil surfaces simply to compensate for the weight of the equipment. However, the aerodynamic structure itself does not necessarily include any such cambered surfaces.

It can now be appreciated from the above that the present invention provides a unique aerodynamic structure having lift which is very simple in design and functions very unexpectedly, as a result of its dihedral shape. Furthermore, because the dihedral angle is variable, whether through control means or in response to dynamic pressure, the lift of the structure varies in accordance with its speed. As a toy having a spring hinge the structure has self-correcting flight characteristics and will perform loops and spirals to provide hours of interesting acrobatics of different flight behaviours.

Although various preferred embodiments of the invention have been described herein in detail, it will be apparent to those skilled in the art that variations may be made thereto without departing from the spirit of the invention or the scope of the appended claims.

What I claim is:

1. An aerodynamic structure having self-correcting flight properties; said aerodynamic structure comprising first and second corresponding planar sections connected at their roots to one another centrally of the aerodynamic structure by a springy hinging connection and moveable relative to one another through corresponding dihedral angles; each of said sections comprising: a forward wing, a body portion, and a rear empennage moveable in unison with one another and said sections being moveable from a widespread glide position to an essentially folded projectile position in response to dynamic pressures to substantially alter the equilibrium state and stability of the structure during flight.

2. An aerodynamic structure as defined in claim 1, wherein each of said sections comprises a large forward wing, a narrow elongated body portion and a small empennage section.

3. An aerodynamic structure as defined in claim 2, constructed from a single piece of centrally folded lightweight resilient material exerting forces to maintain a predetermined dihedral angle.

4. An aerodynamic structure as claimed in claim 3, constructed from cardboard and for use as a toy.

* * * * *